US009482225B2

(12) United States Patent
Lewis et al.

(10) Patent No.: US 9,482,225 B2
(45) Date of Patent: Nov. 1, 2016

(54) GEAR PUMP, PUMPING APPARATUS INCLUDING THE SAME, AND AIRCRAFT FUEL SYSTEM INCLUDING GEAR PUMP

(75) Inventors: Steven Alan Lewis, South Bend, IN (US); David Lawrence, South Bend, IN (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 267 days.

(21) Appl. No.: 13/487,683

(22) Filed: Jun. 4, 2012

(65) Prior Publication Data

US 2013/0320147 A1 Dec. 5, 2013

(51) Int. Cl.

| | |
|---|---|
| ***F04C 2/18*** | (2006.01) |
| ***F04C 15/00*** | (2006.01) |
| *F04C 11/00* | (2006.01) |

(52) U.S. Cl.

CPC ..... *F04C 2/18* (2013.01); *F04C 15/0088* (2013.01); *F04C 15/0096* (2013.01); *F04C 11/005* (2013.01); *F04C 2210/1044* (2013.01); *F04C 2240/56* (2013.01)

(58) Field of Classification Search

CPC ..... F04C 15/0096; F04C 2210/1044; F04C 2240/56; F04C 2/18; F04C 2/14; F02C 7/22

USPC ..... 418/83, 1; 417/203

See application file for complete search history.

(56) References Cited

U.S. PATENT DOCUMENTS

| | | | | |
|---|---|---|---|---|
| 2,775,209 A | | 12/1956 | Albright | |
| 2,955,537 A | * | 10/1960 | Gaubatz | 417/203 |
| 3,073,251 A | | 1/1963 | Weigert | |
| 3,622,212 A | | 11/1971 | Laumont | |
| 3,894,813 A | * | 7/1975 | Cooper | 417/76 |
| 4,038,000 A | | 7/1977 | Dworak | |
| 4,090,820 A | | 5/1978 | Teruyama | |

(Continued)

FOREIGN PATENT DOCUMENTS

| | | |
|---|---|---|
| EP | 1978224 A2 | 10/2008 |
| GB | 572967 | 10/1945 |

(Continued)

OTHER PUBLICATIONS

Positive Displacement Rotary Gear Pumps, Gorman-Rupp Pumps, GRpumps.com, 2009.

(Continued)

*Primary Examiner* — Kenneth Bomberg
*Assistant Examiner* — Paul Thiede
(74) *Attorney, Agent, or Firm* — Ingrassia, Fisher & Lorenz, P.C.

(57) ABSTRACT

A pumping apparatus includes a gear pump in fluid communication with a boost pump. The gear pump includes a pump housing, a first gear, and a second gear. The first and second gear have gear teeth and trunnions on opposite sides thereof, and are disposed in the pump housing. The gear teeth of the first and second gear are meshed in a mesh region. An inlet cavity is defined adjacent to the first and second gear, on one side of the mesh region. A pump outlet is defined on an opposite side of the mesh region from the inlet cavity. A bearing is configured to support at least one trunnion of the first gear and/or the second gear. A bearing interface is defined between the bearing and the at least one trunnion. A flow path is defined between the bearing interface and the inlet cavity.

19 Claims, 7 Drawing Sheets

(56) References Cited

U.S. PATENT DOCUMENTS

| | | | | |
|---|---|---|---|---|
| 4,160,630 | A | 7/1979 | Wynn | |
| 4,265,602 | A | 5/1981 | Teruyama | |
| 4,392,798 | A | 7/1983 | Bowden | |
| 4,553,915 | A | 11/1985 | Eley | |
| 4,629,405 | A | 12/1986 | Hidasi et al. | |
| 4,859,161 | A | 8/1989 | Teruyama et al. | |
| 4,927,343 | A | 5/1990 | Lonsberry | |
| 4,974,702 | A | 12/1990 | Yokomachi et al. | |
| 6,280,164 | B1 | 8/2001 | Kalt et al. | |
| 6,524,088 | B2 | 2/2003 | Kasai et al. | |
| 6,996,970 | B2 | 2/2006 | Lorenz | |
| 2003/0053923 | A1 | 3/2003 | Eaton et al. | |
| 2008/0063554 | A1* | 3/2008 | Gifford et al. | 418/126 |

FOREIGN PATENT DOCUMENTS

| | | | |
|---|---|---|---|
| GB | 1149279 | | 4/1969 |
| GB | 1177922 | | 1/1970 |
| JP | 04-036082 | | 2/1992 |
| JP | 09317656 | A * | 12/1997 |
| WO | WO/00/19067 | | 4/2000 |

OTHER PUBLICATIONS

EP Search Report for Application No. 13167324.6 Dated Feb. 1, 2016.

EP Examination Report for Application No. 13167324.6 Dated Feb. 22, 2016.

* cited by examiner

GEAR PUMP, PUMPING APPARATUS INCLUDING THE SAME, AND AIRCRAFT FUEL SYSTEM INCLUDING GEAR PUMP

TECHNICAL FIELD

The present invention generally relates to a gear pump, a pumping apparatus including the gear pump, and an aircraft fuel system including the gear pump. In particular, the present invention relates to a gear pump that promotes pumping efficiency by cooling bearings thereof with lightly pressurized liquid feed, a pumping apparatus including the gear pump, and an aircraft fuel system including the gear pump.

BACKGROUND

Typical gas turbine engine fuel supply systems include a fuel source, such as a fuel tank, and one or more pumps that draw fuel from the fuel tank and deliver pressurized fuel to the fuel manifolds and fuel nozzles in the engine combustor via a main supply line. These pumps may include an aircraft or tank level pump, a boost pump, and a high pressure pump. The boost pump is typically a centrifugal pump and the high pressure pump is typically a gear pump, though in some applications the high pressure pump may also be a centrifugal pump. In aircraft fuel systems, the pressurized fuel is provided from the boost pump to the high pressure pump.

Gear pumps generally include a pump housing, with a first gear and a second gear disposed in the pump housing. The first gear and the second gear have gear teeth that are meshed in a mesh region, with rotation of the first gear and the second gear pressurizing liquid feed, such as fuel in the fuel supply systems. In this regard, the pump housing generally defines an inlet cavity adjacent to the first gear and the second gear on one side of the mesh region, and a pump outlet adjacent to the first gear and the second gear on an opposite side of the mesh region from the inlet cavity. The pump outlet includes high pressure liquid feed due to pressurization of the liquid feed by rotation of the first gear and the second gear, whereas the inlet cavity includes liquid feed at lower pressures than at the pump outlet.

The first gear and the second gear each generally include trunnions on opposite sides of the first gear and the second gear for supporting the first gear and the second gear during rotation. Due to rotation of the first gear and the second gear, the trunnions generally generate high temperatures attributable to friction, and a cooling flow of liquid feed is generally employed to cool the trunnions. The trunnions are generally cooled by returning a portion of the high pressure liquid feed from the pump outlet, along a surface of the trunnions, and out to the inlet cavity, thereby exploiting a pressure differential between the pump outlet and the inlet cavity to drive flow of the liquid feed along the surface of the trunnions. However, cooling the trunnions with high pressure liquid feed from the pump outlet negatively impacts pump efficiency.

Other techniques for cooling trunnions in gear pumps have been proposed that employ liquid feed from the inlet cavity. One such technique relies upon low pressure zones created in the mesh region as the gear teeth separate to draw liquid feed into channels disposed in the mesh region and that urge the liquid feed from the inlet cavity to the surface of the trunnions. Another such technique relies upon location of channels that provide liquid feed to the surface of the trunnions in an inertial flow path of liquid feed into the inlet cavity, with suction from rotation of the first gear and second gear drawing the liquid feed into the inlet cavity and with inertia of the liquid feed causing the liquid feed to flow into the channels instead of to the first gear and the second gear. However, such techniques often provide inconsistent cooling of the trunnions because the rate of fluid flow to the trunnions is dependent upon multiple factors, including the rotational speed of the gears and dynamic fluid flow profiles within the gear pumps.

Accordingly, it is desirable to provide a gear pump that promotes efficiency in pressurizing liquid feed, such as fuel, by cooling the trunnions with liquid feed from a low-pressure inlet cavity of the gear pump, while avoiding inconsistent cooling associated with existing gear pumps that cool trunnions with liquid feed from the low-pressure inlet cavity. It is also desirable to provide a pumping apparatus and an aircraft fuel system including the gear pump. Furthermore, other desirable features and characteristics of the present invention will become apparent from the subsequent detailed description of the invention and the appended claims, taken in conjunction with the accompanying drawings and this background of the invention.

BRIEF SUMMARY

A gear pump, pumping apparatus, and aircraft fuel system are provided. In an embodiment, a pumping apparatus includes a boost pump, in fluid communication with a source of liquid feed, configured to pressurize the liquid feed to produce a lightly pressurized liquid feed. A gear pump, in fluid communication with the boost pump, is configured to receive the lightly pressurized liquid feed from the boost pump and to further pressurize the lightly pressurized liquid feed to produce a high pressure liquid feed. The gear pump includes a pump housing, a first gear, and a second gear. The first gear and the second gear have gear teeth and are disposed in the pump housing. The gear teeth of the first gear and the gear teeth of the second gear are meshed in a mesh region and the first gear and the second gear each include respective trunnions on opposite sides thereof. An inlet cavity is defined in the pump housing adjacent to the first gear and the second gear, on one side of the mesh region. The inlet cavity is configured to urge the lightly pressurized liquid feed to the first gear and the second gear. A pump outlet is defined in the pump housing adjacent to the first gear and the second gear, on an opposite side of the mesh region from the inlet cavity. The pump outlet is configured to convey the high pressure liquid feed from the gear pump. A bearing is configured to support at least one trunnion of the first gear and/or the second gear. A bearing interface is defined between the bearing and the at least one trunnion. A flow path is defined between the bearing interface and the inlet cavity to provide the lightly pressurized liquid feed to the bearing interface under pressure from the boost pump.

In another embodiment, an aircraft fuel system includes a fuel tank, a boost pump, a gear pump, and a main fluid line. The boost pump is in fluid communication with the fuel tank and is configured to receive fuel from the fuel tank and to pressurize the fuel from the fuel tank to produce a lightly pressurized fuel. The gear pump is in fluid communication with the boost pump and is configured to receive the lightly pressurized fuel from the boost pump and to further pressurize the lightly pressurized fuel to produce a high pressure fuel. The main fuel line is in fluid communication with the gear pump and is configured to receive the high pressure fuel from the gear pump. The gear pump includes a pump housing, a first gear, and a second gear. The first gear and the second gear have gear teeth and are disposed in the pump housing. The gear teeth of the first gear and the gear teeth of the second gear are meshed in a mesh region and the first gear and the second gear each include respective trunnions on opposite sides thereof. An inlet cavity is defined in the pump housing adjacent to the first gear and the second gear, on one side of the mesh region. The inlet cavity is configured to urge the lightly pressurized liquid feed to the first gear and the second gear. A pump outlet is defined in the pump housing adjacent to the first gear and the second gear, on an opposite side of the mesh region from the inlet cavity. The pump outlet is configured to convey the high pressure liquid feed from the gear pump. A bearing is configured to support at least one trunnion of the first gear and/or the second gear. A bearing interface is defined between the bearing and the at least one trunnion. A flow path is defined between the bearing interface and the inlet cavity to provide the lightly pressurized liquid feed to the bearing interface under pressure from the boost pump.

In another embodiment, a gear pump includes a pump housing, a first gear, and a second gear. The first gear and the second gear have gear teeth and are disposed in the pump housing. The gear teeth of the first gear and the gear teeth of the second gear are meshed in a mesh region and define travel patterns. The first gear and the second gear each include respective trunnions on opposite sides thereof. An inlet cavity is defined in the pump housing adjacent to the first gear and the second gear, on one side of the mesh region. The inlet cavity is configured to urge the lightly pressurized liquid feed to the first gear and the second gear. A pump outlet is defined in the pump housing adjacent to the first gear and the second gear, on an opposite side of the mesh region from the inlet cavity. The pump outlet is configured to convey the high pressure liquid feed from the gear pump. A bearing is configured to support at least one trunnion of the first gear and/or the second gear. A bearing interface is defined between the bearing and the at least one trunnion. A flow path is defined between the bearing interface and the inlet cavity. An opening to the flow path from the inlet cavity is radially spaced from the travel patterns of the gear teeth of the first gear and the gear teeth of the second gear. The opening is configured for flow of the pressurized liquid feed into the flow path transverse to a direction of pressurized liquid feed flow into the inlet cavity to provide the lightly pressurized liquid feed to the bearing interface.

BRIEF DESCRIPTION OF THE DRAWINGS

The present invention will hereinafter be described in conjunction with the following drawing figures, wherein like numerals denote like elements, and wherein.

DETAILED DESCRIPTION

Figure 1:
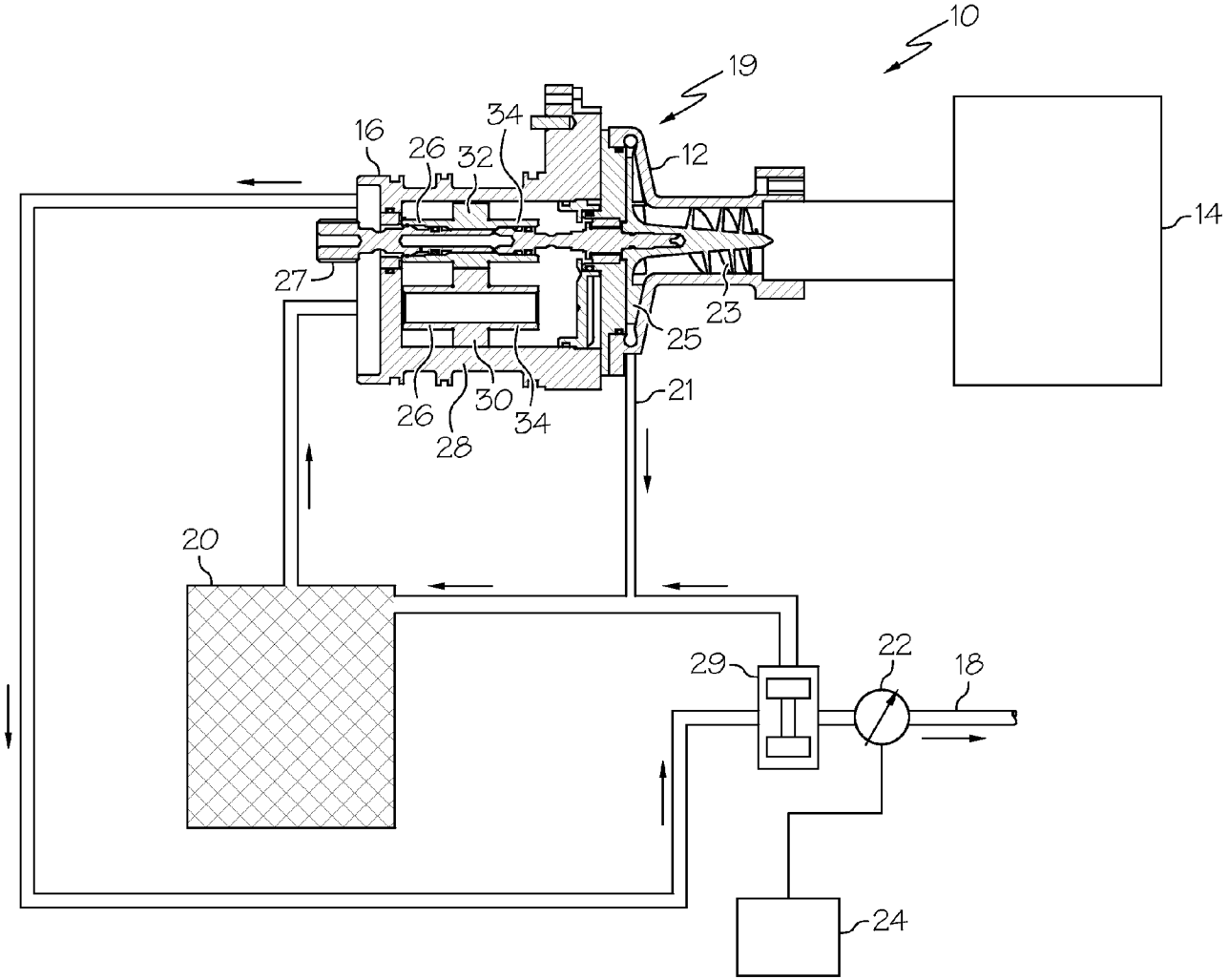
FIG. 1 is a schematic view of an aircraft fuel system in accordance with an embodiment including a boost pump, a gear pump, and a main fuel line.

The following detailed description is merely exemplary in nature and is not intended to limit the invention or the application and uses of the invention. Furthermore, there is no intention to be bound by any theory presented in the preceding background or the following detailed description.

A gear pump, pumping apparatus, and aircraft fuel system are provided herein. The pumping apparatus includes the gear pump and a boost pump. While the pumping apparatus and the gear pump are not limited any particular system, in an embodiment, the gear pump and pumping apparatus are included in the aircraft fuel system. The boost pump is in fluid communication with a source of liquid feed, and the gear pump is in fluid communication with the boost pump. The gear pump is configured to receive lightly pressurized liquid feed from the boost pump and to further pressurize the lightly pressurized liquid feed to produce a high pressure liquid feed. The gear pump includes a first gear and a second gear having trunnions on opposite sides of the first gear and the second gear. A bearing is configured to support at least one trunnion of the first gear and/or the second gear and a bearing interface is defined between the bearing and the at least one trunnion. The gear pump promotes efficiency in pressurizing liquid feed, such as fuel in the aircraft fuel system, by cooling the trunnions with the lightly pressurized liquid feed from a low-pressure inlet cavity of the gear pump instead of with the high pressure liquid feed from a pump outlet of the gear pump. The lightly pressurized liquid feed is provided to the bearing interface through a flow path that is defined between the bearing interface and the inlet cavity. To avoid inconsistent cooling, the lightly pressurized liquid feed is provided to the bearing interface under pressure from the boost pump of the pumping apparatus, which lightly pressurizes the liquid feed to the gear pump to also minimize cavitation during operation of the gear pump. By lightly pressurized liquid feed, or lightly pressurizing, it is meant that the boost pump elevates the pressure of the liquid feed above a pressure of the liquid feed from the source of liquid feed, but below a pressure of the high pressure liquid feed that exits the gear pump. Providing the lightly pressurized liquid feed to the bearing interface does not materially reduce the pressure of the lightly pressurized liquid feed to the gear pump and, therefore, has an immaterial impact on minimizing cavitation during operation of the gear pump. Thus, in addition to lightly pressurizing the liquid feed to avoid cavitation in the gear pump, the lightly pressurized liquid feed, under pressure from the boost pump, is also used to cool at least one trunnion in the gear pump. Because the lightly pressurized liquid feed is provided to the bearing surface under pressure from the boost pump, location of an opening to the flow path is unrestricted in the inlet cavity and can be positioned to avoid impact on flow of lightly pressurized liquid feed to the first gear and the second gear.

An exemplary embodiment of an aircraft fuel system will now be described with reference to FIG. 1. An exemplary aircraft fuel system 10 includes a boost pump 12, a fuel tank 14, a gear pump 16, and a main fuel line 18. The boost pump 12 and the gear pump 16 are components of a pumping apparatus 19 within the aircraft fuel system 10 and are shown in further detail in FIG. 2. The pumping apparatus 19, in addition to the boost pump 12 and the gear pump 16, may further include an interconnecting fluid line 21 (shown in FIG. 1) that connects the boost pump 12 and the gear pump 16. The boost pump 12, which may be a centrifugal pump 12 including an inducer section 23 and an impeller section 25, is in fluid communication with the fuel tank 14 and is configured to receive fuel from the fuel tank 14 and to pressurize the fuel from the fuel tank 14 to produce a lightly pressurized fuel. In the aircraft fuel system 10, the boost pump 12 produces the lightly pressurized fuel to minimize cavitation during operation of the gear pump 16, and the boost pump 12 may also be employed to maintain constant pressure in the main fuel line 18. In an embodiment, the lightly pressurized fuel from the boost pump 12 has a pressure in the range of about 5 to about 1000 KPa, depending upon particular conditions under which the aircraft fuel system 10 is operating.

The gear pump 16 is in fluid communication with the boost pump 12, such as through the interconnecting fluid line 21, is configured to receive the lightly pressurized fuel from the boost pump 12 and to further pressurize the lightly pressurized fuel to produce a high pressure fuel. For example, in an embodiment, the gear pump 16 produces the high pressure fuel having a pressure of from about 1500 to about 9000 KPa. The main fuel line 18 is in fluid communication with the gear pump 16 and is configured to receive the high pressure fuel from the gear pump 16. A fuel filter 20 is optionally disposed between the boost pump 12 and the gear pump 16, within the interconnecting fluid line 21 that connects the boost pump 12 and the gear pump 16. As set forth in further detail below, pressure from the boost pump 12 is also used to provide lightly pressurized fuel for cooling within the gear pump 16. A metered flow valve 22 may be disposed after the gear pump 16 and prior to the main fuel line 18 for controlling fuel flow out of the aircraft fuel system 10, and the metered flow valve 22 may be controlled by a computer control module 24 of the aircraft. A bypass valve 29 may be disposed in the main fuel line 18 prior to the metered flow valve 22 and after the gear pump 16.

Figure 2:
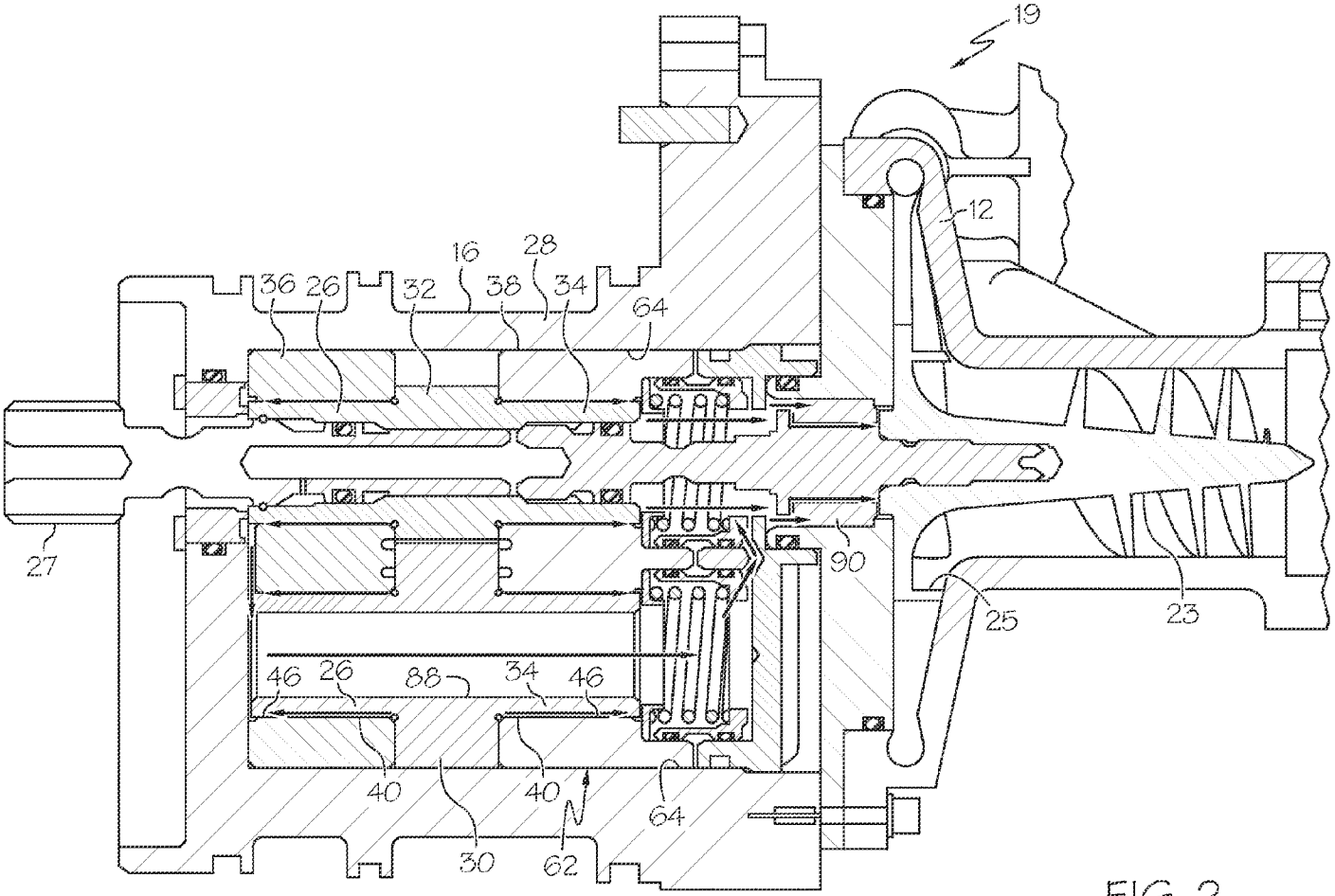
FIG. 2 is a cross-sectional side view of a pumping apparatus in accordance with an embodiment including a boost pump and a gear pump.

Referring to FIGS. 2-5, an exemplary embodiment of a gear pump 16 in the pumping apparatus 19 will now be described. The pumping apparatus 19 and the gear pump 16, while suitable for the aircraft fuel system 10, are not limited to aircraft applications and can be employed in any system where pressurization of liquid feed is desired. As shown in FIG. 2, the gear pump 16 includes a pump housing 28 that encloses most components of the gear pump 16. In an embodiment, a driveshaft 27 extends into the pump housing 28 for driving the gear pump 16. Optionally, the driveshaft 27 is a common driveshaft 27 with the boost pump 12, such as the centrifugal pump 12 as shown in FIGS. 1 and 2.

Referring to FIG. 2, the gear pump 16 further includes a first gear 30 and a second gear 32 disposed in the pump housing 28. The first gear 30 and the second gear 32 rotate within the pump housing 28 to pressurize liquid feed flowing through the gear pump 16 through positive displacement. The first gear 30 and the second gear 32 each include respective trunnions 26, 34 on opposite sides of thereof for supporting the first gear 30 and the second gear 32 during rotation. A bearing 36 is configured to support at least one trunnion 26 and/or 34 of the first gear 30 and/or the second gear 32 with a bearing interface 40 defined between the bearing 36 and the at least one trunnion 26 and/or 34. As referred to herein, the bearing 36 refers to any structure that interfaces between fixed portions of the gear pump 16 and one or more trunnions 26 and/or 34 of the first gear 30 and/or second gear 32. In this regard, the bearing 36 can be any type of bearing known in the art including, but not limited to, a journal bearing, roller bearing, and the like. In an embodiment, and as shown in FIG. 2, the bearing 36 is a journal bearing and supports the trunnions 26 of the first gear 30 and the second gear 32 on one side of the first gear 30 and the second gear 32. As also shown in FIG. 2, an opposing bearing 38 is configured to support the trunnions 34 of the first gear 30 and the second gear 32 on another side of the first gear 30 and the second gear 32. In this manner, the bearing 36 and the opposing bearing 38 secure the first gear 30 and the second gear 32 in place. As shown in the exemplary gear pump 16 of FIG. 2, the bearing 36 represents a fixed bearing of the gear pump 16 and the opposing bearing 38 represents a floating bearing; however, the bearing 36 and opposing bearing 38 as described herein are not so constrained to such designations and the terminology merely reflects the opposing nature of the bearing 36 and the opposing bearing 38.

Figure 3:
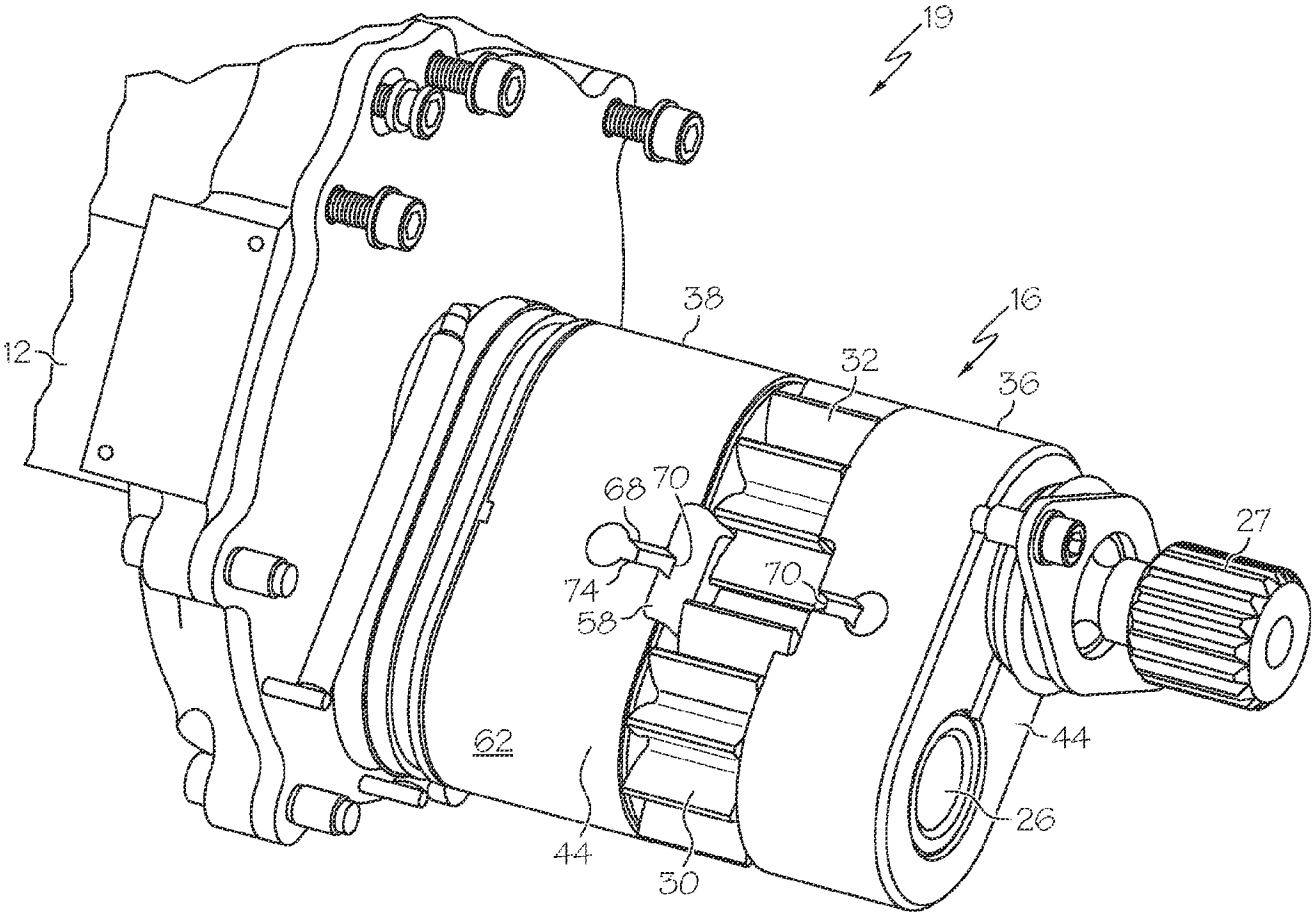
FIG. 3 is a partial perspective view of the pumping apparatus of FIG. 2 with a pump housing removed from the gear pump.
Figure 4:
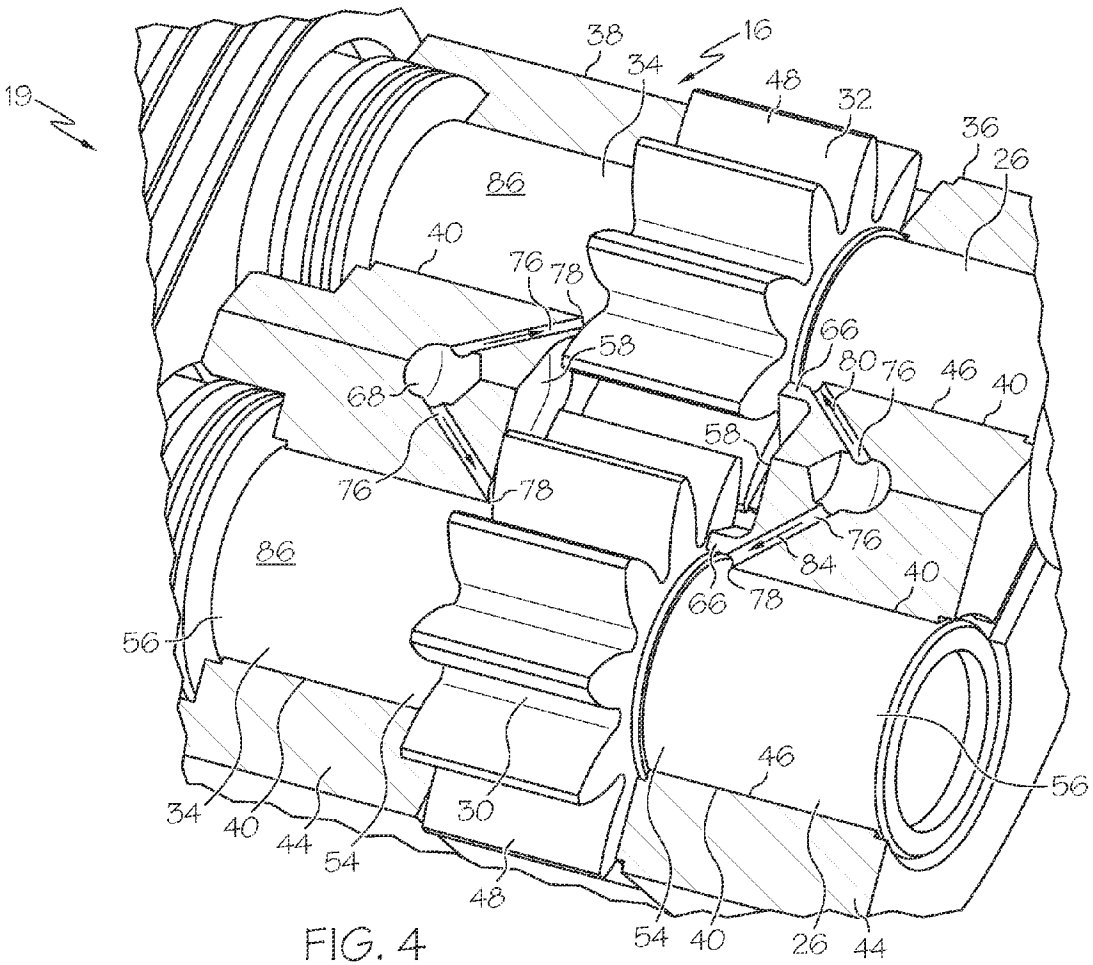
FIG. 4 is a partial cutaway perspective view of a first gear and the second gear in the gear pump of FIG. 2 with portions of a bearing and an opposing bearing removed.
Figure 5:
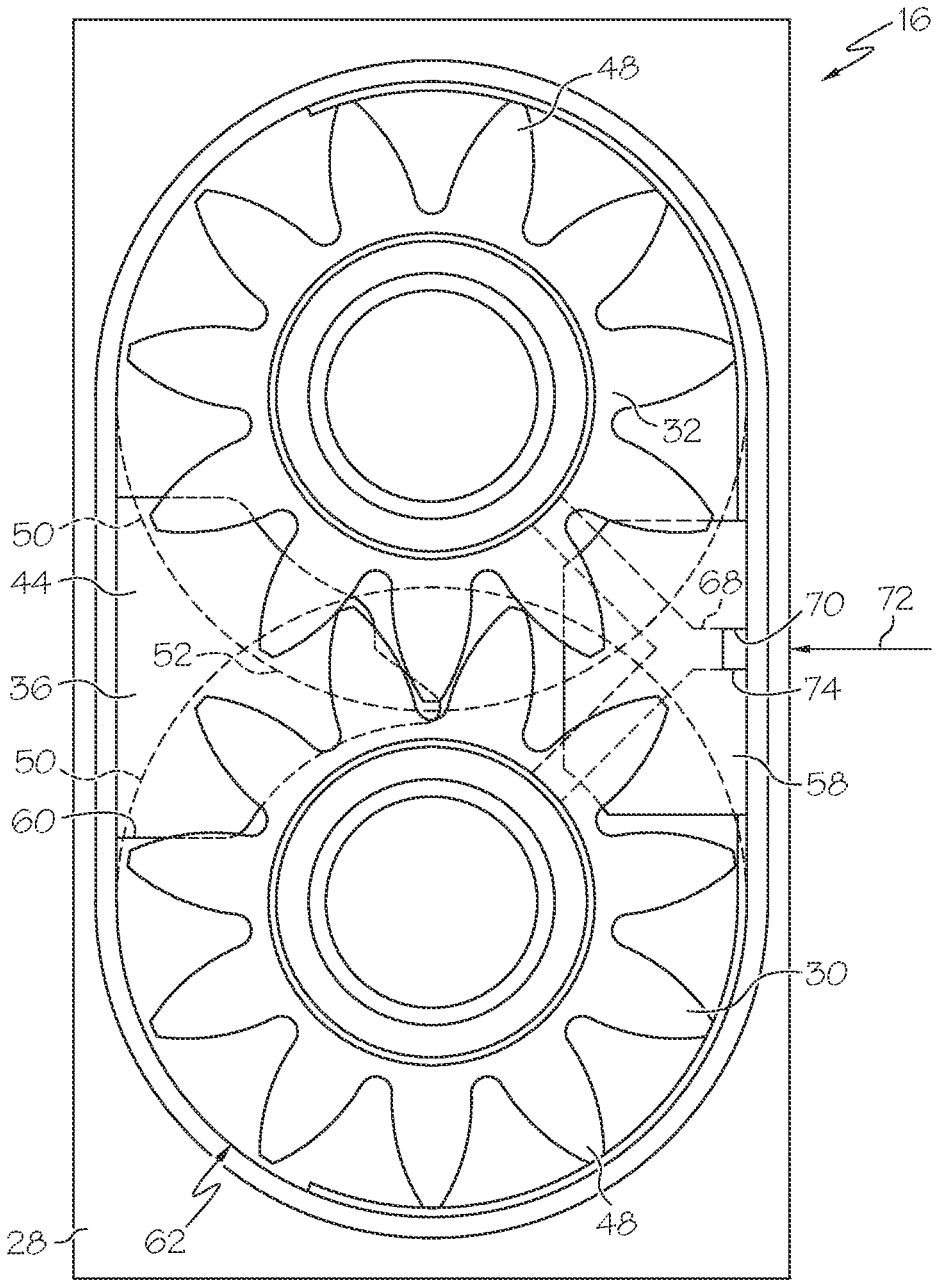
FIG. 5 is a schematic side view of the first gear, the second gear, and a bearing of the gear pump of FIG. 2.

FIGS. 3-5 show the first gear 30, the second gear 32, and a relationship between the first gear 30 and the second gear 32 to each other and to the bearing 36 and opposing bearing 38 of the gear pump 16. In particular, FIG. 3 provides a perspective view of the first gear 30, the second gear 32, and bearings 36, 38 with the pump housing 28 removed, FIG. 4 provides a partial cutaway perspective view of the first gear 30 and the second gear 32 with portions of the bearings 36, 38 cutaway to illustrate internal features of the bearing 36 and the opposing bearing 38, the first gear 30, and the second gear 32, and FIG. 5 provides a side view of the first gear 30, the second gear 32, and the bearing 36. The first gear 30 and the second gear 32 each have gear teeth 48 and, as shown in FIG. 5, the gear teeth 48 of the first gear 30 and the gear teeth 48 of the second gear 32 define travel patterns 50 as the first gear 30 and the second gear 32 rotate within the pump housing 28. The first gear 30 and the second gear 32 are meshed in a mesh region 52 as shown in FIG. 5. As set forth herein, the mesh region 52 refers to overlapping portions of the travel patterns 50 of the gear teeth 48 of the first gear 30 and the gear teeth 48 of the second gear 32.

Referring to FIG. 4, the trunnions 26, 34 have a first end 54 adjacent to the gear teeth 48 of the respective first gear 30 or second gear 32, and the trunnions 26, 34 also have a second end 56 spaced from the gear teeth 48 of the respective first gear 30 or second gear 32. In particular, the first end 54 of the trunnions 26, 34 is closer to the gear teeth 48 than the second end 56 of the trunnions 26, 34, and the first end 54 is generally attached adjacent the gear teeth 48.

Figure 6:
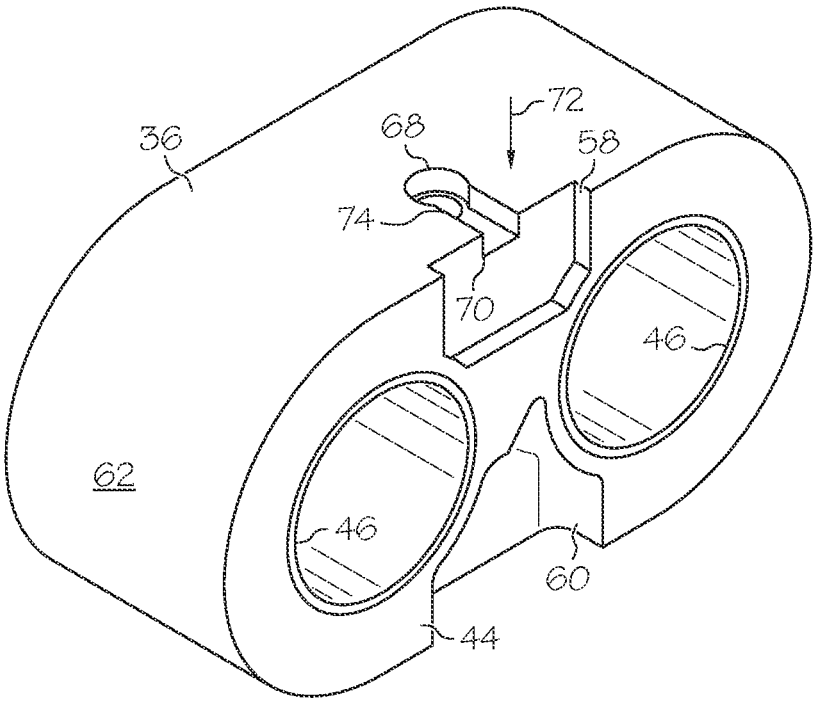
FIG. 6 is a perspective view of the bearing shown in FIG. 5.

As partially shown in FIGS. 3 and 4, the gear pump 16 further includes an inlet cavity 58 defined in the pump housing 28 adjacent to the first gear 30 and the second gear 32, on one side of the mesh region 52 of the first gear 30 and the second gear 32. The inlet cavity 58 is configured to urge the lightly pressurized liquid feed to the first gear 30 and the second gear 32. A pump outlet 60 is also defined in the pump housing 28 adjacent to the first gear 30 and the second gear 32, on an opposite side of the mesh region 52 from the inlet cavity 58. The pump outlet 60 is configured to convey the high pressure liquid feed from the first gear 30 and the second gear 32 and, ultimately, out of the gear pump 16. In an embodiment, and as shown in FIGS. 5 and 6, the bearing 36 and the opposing bearing 38 include a bearing body 44 that defines a portion of the inlet cavity 58 and the pump outlet 60, with fluid communication between the inlet cavity 58 and the pump outlet 60 effectively controlled by the first gear 30 and the second gear 32 during operation of the gear pump 16. In particular, fluid flow between the inlet cavity 58 and the pump outlet 60 is restricted to transporting liquid feed by way of the first gear 30 and the second gear 32, with no alternative flow paths for returning liquid feed from the pump outlet 60 to the inlet cavity 58. As shown in FIG. 2, the bearing bodies 44 of the bearing 36 and opposing bearing 38 have a peripheral surface 62 that abuts inner surfaces 64 of the pump housing 28. Although not shown in the figures, forces acting upon the bearing bodies 44 during operation of the gear pump 16 hold the bearing bodies 44 against the inner surface 64 of the pump housing 28 to effectively create sealed zones of low pressure liquid feed and high pressure liquid feed.

Figure 7:
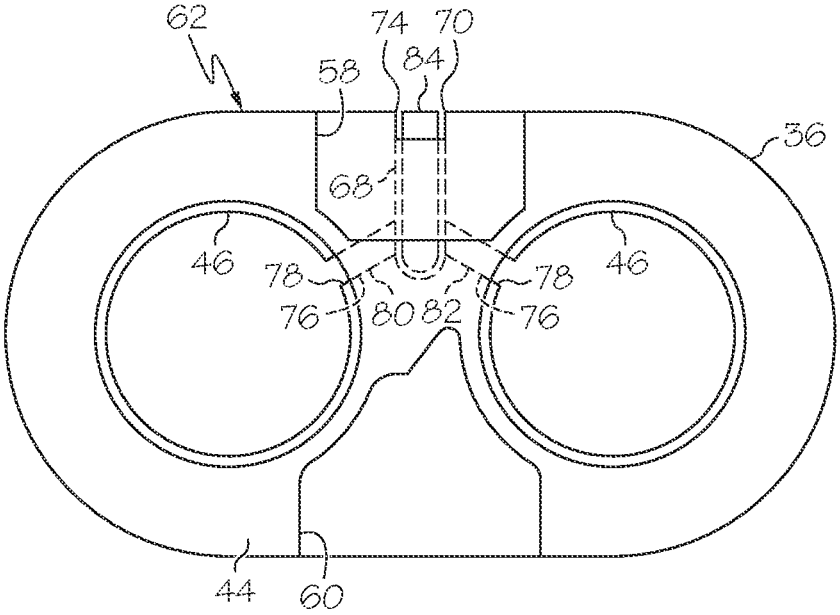
FIG. 7 is a side view of the bearing shown in FIG. 6.

In an embodiment, and as shown in FIGS. 6 and 7, the bearing 36 also includes a bearing surface 46, with the bearing surface 46 and the at least one trunnion 26 and/or 34 defining the bearing interface 40 therebetween as shown in FIG. 4. A seal surface 66 may be disposed between the at least one trunnion 26 and/or 34 and the gear teeth 48 to prevent fluid flow from the bearing interface 40 to spaces between the gear teeth 48. In particular, as shown in FIG. 4, the bearing body 44 may define the seal surface 66 as a portion thereof disposed between the bearing surface 46 and the inlet cavity 58, and the seal surface 66 effectively isolates direct fluid flow from the bearing interface 40 to the inlet cavity 58 or to spaces between the first gear 30 and the second gear 32.

Referring to FIGS. 3-8, a flow path 68 is defined between the bearing interface 40 and the inlet cavity 58 to provide the lightly pressurized liquid feed to the bearing interface 40 under pressure from the boost pump 12 in the pumping apparatus 19. For purposes herein, fluid flow from the inlet cavity 58 to the bearing interface 40 is restricted to the flow path 68, with the inlet cavity 58 and the bearing interface 40 otherwise sealed from direct fluid flow therebetween. Because the boost pump 12 provides the pressure to the lightly pressurized liquid feed that drives the liquid feed into the flow path 68, an opening 70 to the flow path 68 from the inlet cavity 58 can be located at positions that are not possible when flow dynamics within the gear pump 16 are needed to drive liquid feed into flow paths of existing gear pumps. In an embodiment, and as shown in FIG. 5, the opening 70 to the flow path 68 from the inlet cavity 58 is spaced from the mesh region 52. The mesh region 52 generally includes liquid feed at lower pressures than in the remaining inlet cavity 58 due to vacuum created by separation of the gear teeth 48 during operation of the gear pump 16, and the opening 70 to the flow path 68 is spaced from the mesh region 52 to avoid interference by the vacuum created in the mesh region 52 with predictable flow rates of lightly pressurized liquid feed into the flow path 68. Likewise, in this embodiment, the opening 70 to the flow path 68 may also be radially spaced from the travel patterns 50 of the gear teeth 48 of the first gear 30 and the gear teeth 48 of the second gear 32 to also avoid impact of pressure differentials created by rotation of the gear teeth 48 on flow of lightly pressurized liquid feed into the flow path 68. In particular, the travel patterns 50 of the gear teeth 48 are generally circular, and the opening 70 to the flow path 68 is located outside of the circular travel path of the gear teeth 48. As also shown in FIG. 5 and with further reference to FIG. 6, in an embodiment, the opening 70 to the flow path 68 is configured for flow of the lightly pressurized liquid feed into the flow path 68 transverse to a direction 72 of lightly pressurized liquid feed flow into the inlet cavity 58, thereby minimizing interference by inertial flow of the lightly pressurized liquid feed with predictable flow rates of lightly pressurized liquid feed into the flow path 68 due to pressure from the boost pump 12.

Figure 8:
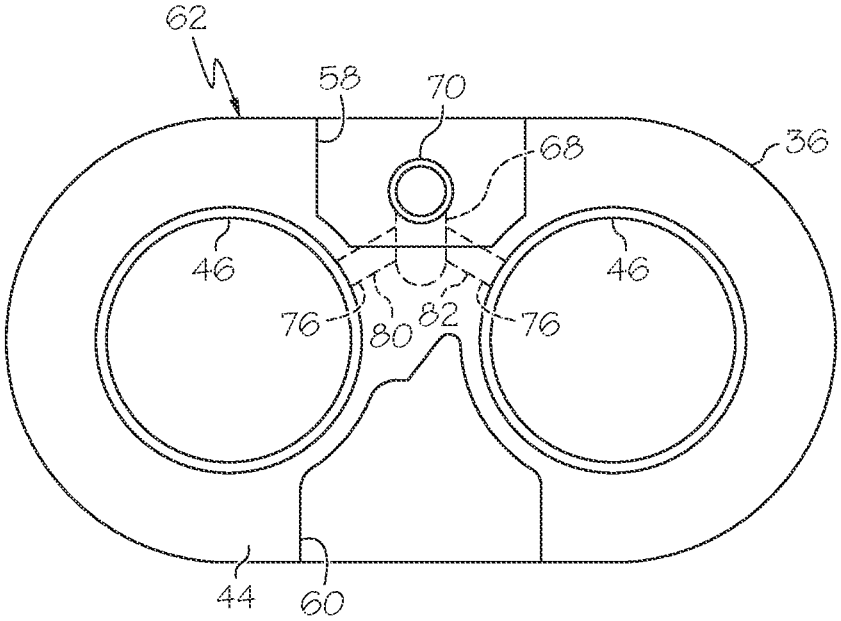
FIG. 8 is a side view of another embodiment of a bearing.

As shown in FIGS. 3-8, in an embodiment, the bearing 36 at least partially defines the flow path 68 between the bearing interface 40 and the inlet cavity 58. More specifically, the bearing body 44 of the bearing 36 at least partially defines the flow path 68. In an embodiment, as shown in FIG. 8, the bearing 36 defines the entire flow path 68 between the bearing interface 40 and the inlet cavity 58. In another embodiment, as shown in FIGS. 3 and 5-7, the peripheral surface 62 of the bearing body 44 defines a first portion 74 of the flow path 68 with the first portion 74 including the opening 70 to the flow path 68 from the inlet cavity 58. In this embodiment, as shown in FIG. 5, the first portion 74 of the flow path 68 is defined between the peripheral surface 62 and another feature of the gear pump 16, such as the inner surface 64 of the pump housing 28, with the peripheral surface 62 defining the first portion 74 of the flow path 68 as a trough 74 that extends along the peripheral surface 62 and with the trough 74 recessed into the bearing body 44. The inner surface 64 of the pump housing 28 and the trough 74 define the first portion 74 of the flow path 68. In other embodiments, although not shown, it is contemplated that the inner surface 64 of the pump housing 28 can define a flow recess that serves the same purpose as the trough defined in the bearing body 44, with the bearing body 44 then being free of the trough.

Referring to FIG. 7, the bearing body 44 defines an entire second portion 76 of the flow path 68, with the second portion 76 of the flow path 68 connected to the first portion 74 of the flow path 68. The second portion 76 includes an egress 78 from the flow path 68 to the bearing interface 40. In effect, the first portion 74 of the flow path 68 transfers lightly pressurized liquid feed from the inlet cavity 58 to the second portion 76 of the flow path 68, which is spaced from the inlet cavity 58 and which enables robust restriction of flow between the inlet cavity 58 and the bearing interface 40. As shown in FIGS. 4 and 7, the flow path 68 splits after the opening 70 from the inlet cavity 58 into a first branch 80 and a second branch 82. In particular, in this embodiment, the flow path 68 splits in the second portion 76 of the flow path 68 to provide lightly pressurized liquid feed to respective trunnions 26 or 34 of the first gear 30 and the second gear 32 that are supported by the bearing 36 of this embodiment. The first branch 80 is in fluid communication with the bearing interface 40 defined between the bearing 36 and the at least one trunnion 26 and/or 34 of the first gear 30 and the second branch 82 is in fluid communication with the bearing interface 40 defined between the bearing 36 and the at least one trunnion 26 and/or 34 of the second gear 32. Of course, it is to be appreciated that in other embodiments, although not shown, the bearing 36 may support a single gear, under which circumstances splitting of the flow path 68 is unnecessary.

In an embodiment, and as shown in FIG. 7, a flow regulator 84 is disposed in the flow path 68 to limit an amount of lightly pressurized liquid feed provided to the bearing interface 40. In the embodiment shown, the flow regulator 84 is a plug and is disposed in the second portion 76 of the flow path 68. The flow regulator 84 is further disposed in the flow path 68 prior to splitting into the first branch 80 and the second branch 82. Flow of the lightly pressurized liquid feed through the flow path 68 may be precisely set with the flow regulator 84 based upon requirements of the gear pump 16 and the particular applications for which the gear pump 16 is employed, with the flow regulator 84 obviating the need to design other features of the flow path 68 to account for such considerations.

Referring to FIG. 4, the egress 78 from the flow path 68 to the bearing interface 40 is defined adjacent the first end 54 of the respective trunnion 26 or 34, i.e., the egress 78 is defined closer to the first end 54 of the respective trunnion 26 or 34 than the second end 56. Flow of the lightly pressurized liquid feed generally proceeds from the first end 54 of the respective trunnion 26 or 34 to the second end 56, along an outer surface 86 of the trunnion 26, 34. In the embodiment of the gear pump 16 as shown in FIG. 2, the lightly pressurized liquid feed proceeds to flow through an inner cavity 88 of the trunnion 26, 34, through low pressure areas within the pump housing 28 to a journal bearing 90 that is configured to support the driveshaft 27 between the gear pump 16 and the boost pump 12.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A pumping apparatus comprising:

a boost pump, in fluid communication with a source of liquid feed, configured to pressurize the liquid feed to produce a lightly pressurized liquid feed;

a gear pump, in fluid communication with the boost pump, configured to receive the lightly pressurized liquid feed from the boost pump and to further pressurize the lightly pressurized liquid feed to produce a high pressure liquid feed, the gear pump comprising:

a pump housing;

a first gear having gear teeth and disposed in the pump housing;

a second gear having gear teeth and disposed in the pump housing, wherein the gear teeth of the first gear and the gear teeth of the second gear are meshed in a mesh region and wherein the first gear and the second gear each include respective trunnions on opposite sides thereof;

a bearing including:

a bearing interface;

a net cavity formed in the bearing adjacent the first gear and the second gear, on one side of the mesh region, the net cavity configured to receive the lightly pressurized liquid feed in a flow direction through the inlet cavity so as to urge the lightly pressurized liquid feed to the first gear and the second gear;

a pump outlet formed in the bearing adjacent the first gear and the second gear, on an opposite side of the mesh region from the net cavity, the pump outlet configured to convey the high pressure liquid feed from the gear pump; and a flow path formed within and through the bearing being disposed between the bearing interface and the net cavity and having a plurality of openings, at least one opening of the plurality of openings being in flow communication with the inlet cavity outside and adjacent to the mesh region upstream of the mesh region in relation to the flow direction, wherein the at least one opening to the flow path is configured for flow of the lightly pressurized liquid feed into the flow path transverse to a direction of lightly pressurized liquid feed flow into the net cavity;

wherein the bearing is configured to support at least one of the trunnions of the first gear and/or the second gear with the bearing interface being disposed between the bearing and the at least one of the trunnions, the flow path providing the lightly pressurized liquid feed to the bearing interface under pressure from the boost pump to lubricate the bearing interface.

2. The pumping apparatus of claim 1, wherein the gear teeth of the first gear and the gear teeth of the second gear define travel patterns and wherein the at least one opening to the flow path is spaced outside and upstream of the travel patterns in relation to the flow direction.

3. The pumping apparatus of claim 1, further comprising a seal surface between the at least one trunnion and the gear teeth of at least one of the first gear or the second gear to prevent fluid flow from the bearing interface to spaces between the gear teeth of the at least one of the first gear or the second gear.

4. The pumping apparatus of claim 1, wherein the bearing defines the entire flow path between the bearing interface and the inlet cavity.

5. The pumping apparatus of claim 1, wherein the bearing comprises a bearing surface, with the bearing surface and the at least one trunnion defining the bearing interface therebetween, and wherein the bearing has a peripheral surface with the peripheral surface defining a first portion of the flow path with the first portion including the at least one opening to the flow path from the net cavity.

6. The pumping apparatus of claim 5, wherein the peripheral surface defines the first portion of the flow path as a trough extending therealong that is recessed into the bearing.

7. The pumping apparatus of claim 6, wherein the first portion of the flow path is further defined by an inner surface of the pump housing, with the inner surface of the pump housing and the trough defining the first portion of the flow path.

8. The pumping apparatus of claim 6, wherein the bearing defines an entire second portion of the flow path connected to the first portion of the flow path with the second portion including an egress from the flow path to the bearing interface.

9. The pumping apparatus of claim 1, wherein the trunnions have a first end adjacent the gear teeth and a second end spaced from the gear teeth, and wherein an egress from the flow path to the bearing interface is defined adjacent the first end.

10. The pumping apparatus of claim 1, wherein a flow regulator is disposed in the flow path to limit an amount of lightly pressurized liquid feed provided to the bearing interface.

11. The pumping apparatus of claim 1, wherein the bearing is configured to support the trunnions of the first gear and the second gear on one side thereof.

12. The pumping apparatus of claim 11, further comprising an opposing bearing configured to support the trunnions of the first gear and the second gear on another side thereof.

13. The pumping apparatus of claim 11, wherein the flow path splits after an opening from the inlet cavity into a first branch and a second branch with the first branch in fluid communication with the bearing interface defined between the bearing and the trunnion of the first gear and with the second branch in fluid communication with the bearing interface defined between the bearing and the trunnion of the second gear.

14. The pumping apparatus of claim 13, wherein a flow regulator is disposed in the flow path prior to splitting into the first branch and the second branch to limit an amount of lightly pressurized liquid feed provided to the bearing interface.

15. The pumping apparatus of claim 1, wherein the boost pump is further defined as a centrifugal pump.

16. The pumping apparatus of claim 1, wherein the at least one opening of the bearing includes:

a first and a second opening and at least one inner opening;

wherein the second opening directly communicates with the first opening and the at least one inner opening directly communicates with the second opening, the at least one inner opening out to the bearing interface adjacent to one of the first and the second gears.

17. The pumping apparatus of claim 16, wherein the bearing includes an outer peripheral surface, wherein the first opening and the second opening are defined in the outer peripheral surface, and the at least one inner opening is defined inbound from the outer peripheral surface.

18. An aircraft fuel system comprising:

a fuel tank;

a boost pump, in fluid communication with the fuel tank, configured to receive fuel from the fuel tank and to pressurize the fuel from the fuel tank to produce a lightly pressurized fuel;

a gear pump, in fluid communication with the boost pump, and configured to receive the lightly pressurized fuel from the boost pump and to further pressurize the lightly pressurized fuel to produce a high pressure fuel, the clear pump comprising:

a pump housing;

a first gear having gear teeth and disposed in the pump housing;

a second gear having gear teeth and disposed in the pump housing, wherein the gear teeth of the first gear and the gear teeth of the second gear are meshed in a mesh region and wherein the first gear and the second gear each include respective trunnions on opposite sides thereof;

a bearing including:

a bearing interface defined between at least one of the trunnions and the bearing;

a net cavity defined in the bearing adjacent the first gear and the second gear, on one side of the mesh region, the net cavity configured to receive the lightly pressurized liquid feed in a flow direction through the inlet cavity so as to apply the lightly pressurized fuel to the first gear and the second gear;

a pump outlet defined in the bearing adjacent the first gear and the second gear, on an opposite side of the mesh region from the net cavity, the pump outlet configured to convey the high pressure fuel from the gear pump;

a flow path formed within and through the bearing being disposed between the bearing interface and the net cavity and having at least one opening that is in flow communication with the inlet cavity outside of and adjacent to the mesh region upstream of the mesh region in relation to the flow direction, wherein the at least one opening to the flow path is configured for flow of the lightly pressurized liquid feed into the flow path transverse to a direction of lightly pressurized liquid feed flow into the net cavity:

wherein the bearing is configured to support at least one of the trunnions of the first gear and/or the second gear and the flow path provides the lightly pressurized fuel to the bearing interface under pressure from the boost pump to lubricate the bearing interface; and a main fuel line, in fluid communication with the gear pump, configured to receive the high pressure fuel from the gear pump.

19. A gear pump comprising:

a pump housing;

a first gear having gear teeth and disposed in the pump housing;

a second gear having gear teeth and disposed in the pump housing, wherein the gear teeth of the first gear and the gear teeth of the second gear are meshed in a mesh region and define travel patterns, and wherein the first gear and the second gear each include respective trunnions on opposite sides thereof;

a bearing including:

a bearing interface defined between at least one of the trunnions and the bearing;

a net cavity defined in the bearing adjacent the first gear and the second gear, on one side of the mesh region, the net cavity configured to receive the lightly pressurized liquid feed in a first direction through the inlet cavity so as to urge a lightly pressurized liquid feed to the first gear and the second gear;

a pump outlet defined in the bearing adjacent the first gear and the second gear, on an opposite side of the mesh region from the net cavity, the pump outlet configured to convey a high pressure liquid feed from the gear pump;

a flow path formed within and through the bearing being disposed between the bearing interface and the net cavity and having at least one opening that is spaced outside and upstream of the travel patterns of the gear teeth of the first gear and the travel patterns of the gear teeth of the second gear in relation to the first direction, the at least one opening further being arranged in the bearing so as to have flow communication with the net cavity such that when the lightly pressurized liquid feed flows in to the net cavity in the first direction, the lightly pressurized liquid feed flows from the net cavity through the at least one opening and into the flow path in a second direction transverse to the first direction;

wherein the bearing is configured to support at least one of the trunnions of the first gear and/or the second gear and the flow path provides the lightly pressurized liquid feed to the bearing interface to lubricate the bearing interface.

* * * * *